US009328721B2

(12) United States Patent
Lee et al.

(10) Patent No.: US 9,328,721 B2
(45) Date of Patent: May 3, 2016

(54) VARIABLE DISPLACEMENT SWASH PLATE TYPE COMPRESSOR

(71) Applicants: DOOWON ELECTRONICS CO., LTD, Asan-si Chungcheongnam-do (KR); DOOWON TECHNICAL COLLEGE, Anseong-si Gyeonggi-do (KR)

(72) Inventors: Geonho Lee, Gyeonggi-do (KR); Tae Jin Lee, Incheon (KR); Seung Won Lee, Anseong-si (KR); Ki Chun Lee, Seoul (KR); Hyun Jae Kim, Seoul (KR)

(73) Assignees: DOOWON ELECTRONICS CO., LTD, Asan-si, Chungcheongnam-do (KR); DOOWON TECHNICAL COLLEGE, Anseong-si, Gyeonggi-do (KR)

( * ) Notice: Subject to any disclaimer, the term of this patent is extended or adjusted under 35 U.S.C. 154(b) by 465 days.

(21) Appl. No.: 13/800,141

(22) Filed: Mar. 13, 2013

(65) Prior Publication Data

US 2013/0343920 A1 Dec. 26, 2013

(30) Foreign Application Priority Data

Jun. 22, 2012 (KR) ..... 10-2012-0067081

(51) Int. Cl.
*F04B 1/29* (2006.01)
*F04B 1/14* (2006.01)

(52) U.S. Cl.
CPC ..... *F04B 1/295* (2013.01); *F04B 1/146* (2013.01)

(58) Field of Classification Search
CPC ..... F04B 1/12; F04B 1/14; F04B 1/141; F04B 1/146; F04B 1/28; F04B 1/29; F04B 1/295; F04B 27/0873; F04B 27/0895; F04B 27/10; F04B 27/1018; F04B 27/1036; F04B 27/1063; F04B 27/1072; F04B 27/16; F04B 27/18
USPC ..... 417/222.1, 222.2; 91/472, 482, 483, 91/499, 504, 505, 506, 507; 74/63, 64; 92/12.2
See application file for complete search history.

(56) References Cited

U.S. PATENT DOCUMENTS

| | | | | |
|---|---|---|---|---|
| 3,388,719 | A * | 6/1968 | Maginnis | 137/565.13 |
| 7,444,921 | B2 * | 11/2008 | Theodore, Jr. | 92/12.2 |
| 2009/0148312 | A1 * | 6/2009 | Ahn | 417/269 |

* cited by examiner

*Primary Examiner* — Nathan J Newhouse
*Assistant Examiner* — Kevin Silas
(74) *Attorney, Agent, or Firm* — Paratus Law Group, PLLC

(57) ABSTRACT

Provided is a variable displacement swash plate type compressor including: a lug plate fixed to a driving shaft; and a swash plate combined to the lug plate and whose tilt angle is varied according to rotatory motion, wherein the lug plate includes a protruding portion protruding towards the swash plate, and a rotatory power projection transmitting power for rotating the swash plate is formed at a leading end of the protruding portion through the swash plate. Accordingly, a varying operation between a maximum tilt angle and a minimum tilt angle of the swash plate and a rotatory power transmitting operation for rotating the swash plate are performed at different locations, thereby simultaneously improving the varying operation and the rotatory power transmitting operation of the swash plate.

9 Claims, 7 Drawing Sheets

(a)

(b)

VARIABLE DISPLACEMENT SWASH PLATE TYPE COMPRESSOR

CROSS-REFERENCE TO RELATED PATENT APPLICATION

This application claims the benefit of Korean Patent Application No. 10-2012-0067081, filed on Jun. 22, 2012, in the Korean Intellectual Property Office, the disclosure of which is incorporated herein in its entirety by reference.

BACKGROUND OF THE INVENTION

1. Field of the Invention

The present invention relates to a variable displacement swash plate type compressor, and more particularly, to a variable displacement swash plate type compressor capable of simultaneously improving a tilt angle varying operation of a swash plate and a rotating operation of a lug plate, by improving a connection structure of the lug plate and the swash plate.

2. Description of the Related Art

Generally, an air conditioning apparatus of a vehicle maintains a temperature inside the vehicle lower than an outdoor temperature by using a refrigerant, and includes a compressor, a condenser, and an evaporator to generate a circulation cycle of the refrigerant.

Such a compressor compresses and pumps the refrigerant, and is driven by power of an engine or by a motor.

Meanwhile, a swash plate type compressor is classified into a variable displacement swash plate type compressor, wherein a swash plate having a disk shape varies a tilt angle of the swash plate according to a rotation of a driving shaft driven by a power of an engine, and a fixed swash plate type compressor installed in a fixed state.

The variable displacement swash plate type compressor can perform a precise flow rate control by controlling a feed rate of a piston as a tilt angle of a swash plate is continuously changed according to a change of heat load, and improve riding comfort of a vehicle by preventing a rapid torque change of an engine due to a compressor.

Hereinafter, a structure of a variable displacement swash plate type compressor according to a conventional technology will now be described with reference to FIGS. 1A and 1B.

As shown in FIG. 1A, the variable displacement swash plate type compressor includes a front housing 10*a* accommodating a cylinder block 20 therein, and a rear housing 10*b*.

A plurality of cylinder bores 21 are formed in the cylinder block 20, and a piston 30 moving back and forth in a straight line is inserted into the cylinder bore 21 and is connected to a shoe 55 combined to an outer circumference of a swash plate 50 slantly combined to a driving shaft 40.

Also, a lug plate 60 for rotating the swash plate 50 is fixed to the driving shaft 40.

Accordingly, the lug plate 60 rotating with the driving shaft 40 rotates the swash plate 50, and Piston 30 moves back and forth while a tilt angle of the swash plate 50 is changed, thereby compressing a refrigerant.

However, looking at a connection structure of the lug plate 60 and the swash plate 50 of the variable displacement swash plate type compressor shown in FIG. 1B, a projection 62 externally protruding and having a guiding slope 61 is formed at the lug plate 60 and an arm 52 having a moving roller 51 rolled with respect to the guiding slope 61 is formed at the swash plate 50, wherein the lug plate 60 and the swash plate 50 are connected via making surface contact with between the projection 62 and the arm 52.

Here, since a tilting movement of the swash plate 50, wherein the swash plate 50 repeatedly moves from a maximum tilt angle to a minimum tilt angle, and a rotatory power transmittance for transmitting rotatory power of the lug plate 60 to the arm 52 of the swash plate 50 are simultaneously performed respectively at two sides of the projection 62, the tilting movement and the rotatory power transmittance are not smoothly performed. Therefore, the variable displacement swash plate type compressor is easily damaged due to a crack caused by durability deterioration according to a load concentrated in the projection 62.

SUMMARY OF THE INVENTION

The present invention provides a variable displacement swash plate type compressor capable of simultaneously improving a tilt angle varying operation of a swash plate and a rotating operation of a lug plate by improving a connection structure between the lug plate and the swash plate.

According to an aspect of the present invention, there is provided a variable displacement swash plate type compressor including: a lug plate fixed to a driving shaft; and a swash plate combined to the lug plate and whose tilt angle is varied according to rotatory motion, wherein the lug plate includes a protruding portion protruding towards the swash plate, and a rotatory power projection transmitting power for rotating the swash plate is formed at a leading end of the protruding portion through the swash plate.

A through hole penetrating through the rotatory power projection of the lug plate may be formed in the swash plate, and a surface contact portion may be formed on two sides of the through hole of the swash plate, wherein the two sides of the through hole may face two sides of the rotatory power projection.

The two sides of the surface contact portion or rotatory power projection may be coated with TEFLON™ for reducing frictional resistance.

An arm protruding from a location near the protruding portion of the lug plate towards the lug plate may be formed at the swash plate.

A pair of arms protruding towards the lug plate on both sides of the protruding portion of the lug plate may be formed at the swash plate, wherein a guide groove and a slope for guiding a tilting movement may be formed at the lug plate while making surface contact with the pair of arms of the swash plate, and a hinge pin sliding and combined to the guide groove may be formed at the pair of arms.

The guide groove may be sunken at a predetermined depth towards an inside of the protruding portion.

The hinge pin may have a connecting shaft shape connecting the pair of arms, and the guide groove may penetrate through the protruding portion for the hinge pin to be elevated therethrough.

A guide member and the slope for guiding a tilting movement may be formed at the lug plate while making surface contact with the pair of arms of the swash plate, and the hinge pin sliding along a coupling hole formed in the guide member may be formed at the pair of arms.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, one or more exemplary embodiments of the present invention will be described more fully with reference to FIGS. 2 through 7.

Figure 2:
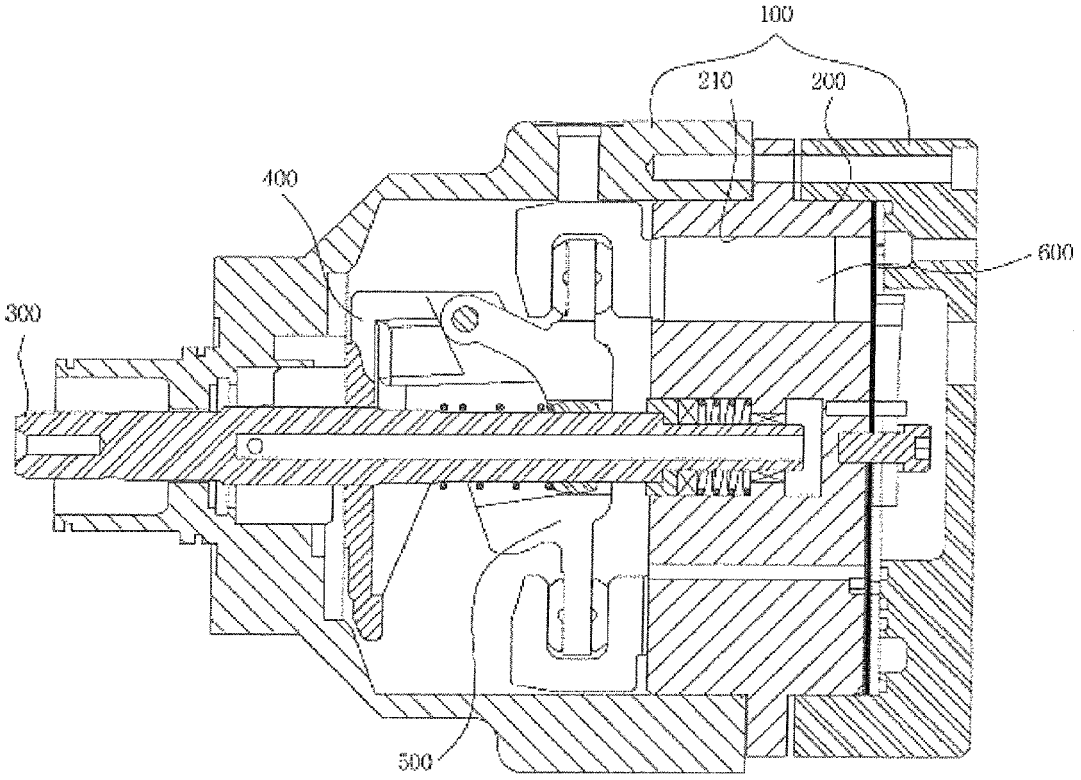
FIG. 2 is a cross-sectional view of a structure of a variable displacement swash plate type compressor according to an embodiment of the present invention.
Figure 3:
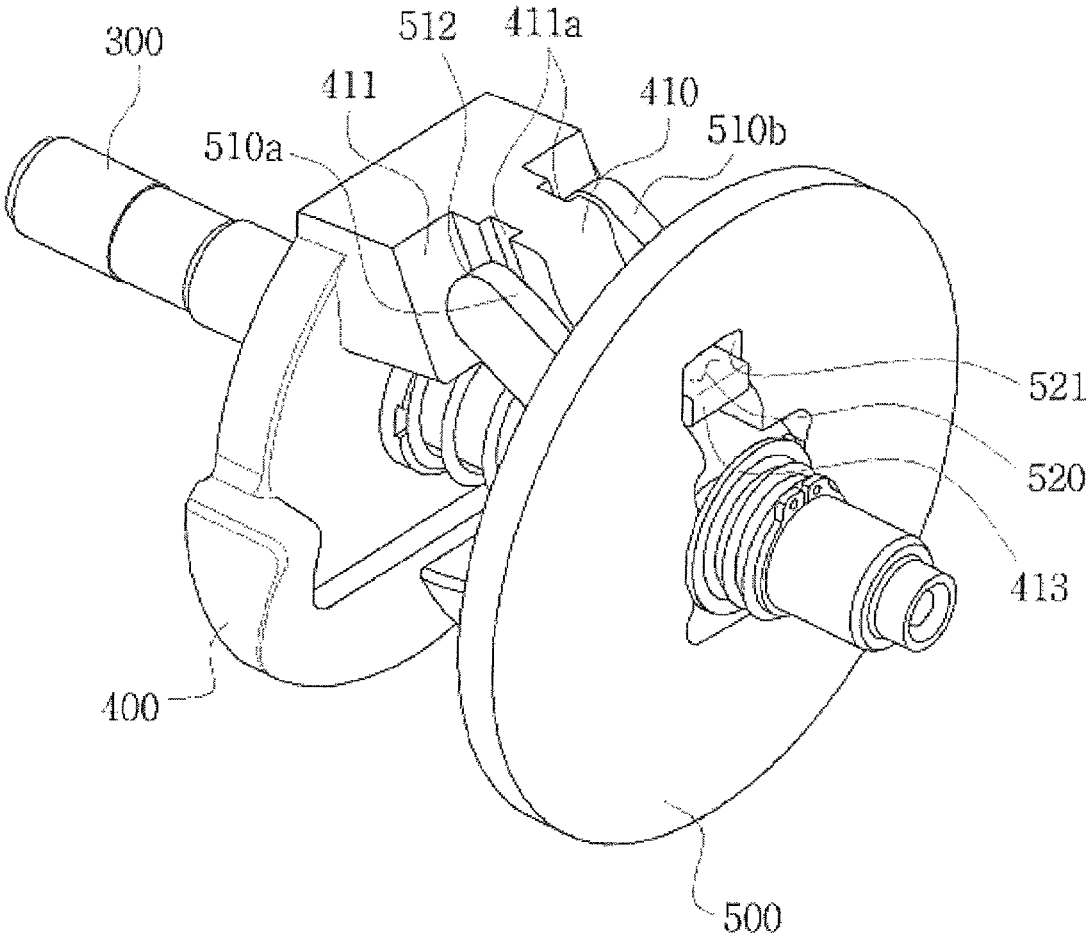
FIG. 3 is a perspective view of a connection structure between a swash plate and a lug plate of FIG. 2.

As shown in FIG. 2, a variable displacement swash plate type compressor includes a housing 100, a cylinder block 200 installed in the housing 100 and including a plurality of cylinder bores 210, a driving shaft 300 rotatably supported by the cylinder block 200, a lug plate 400 fixed to the driving shaft 300, a swash plate 500 whose tilt angle is changed while rotating by the lug plate 400, and a piston 600 accommodated in the cylinder bore 210 to be movable back and forth according to rotation of the swash plate 500.

Figure 1A:
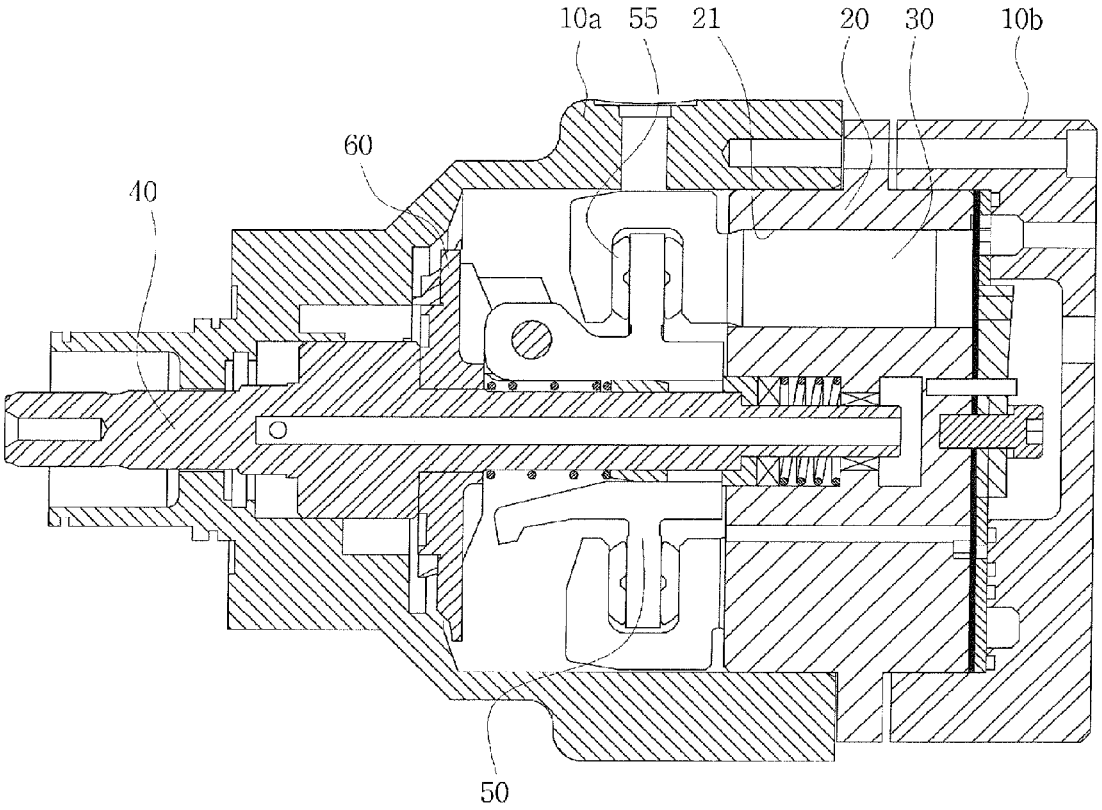
FIG. 1A is a cross-sectional view of a structure of a variable displacement swash plate type compressor according to a conventional technology.
Figure 1B:
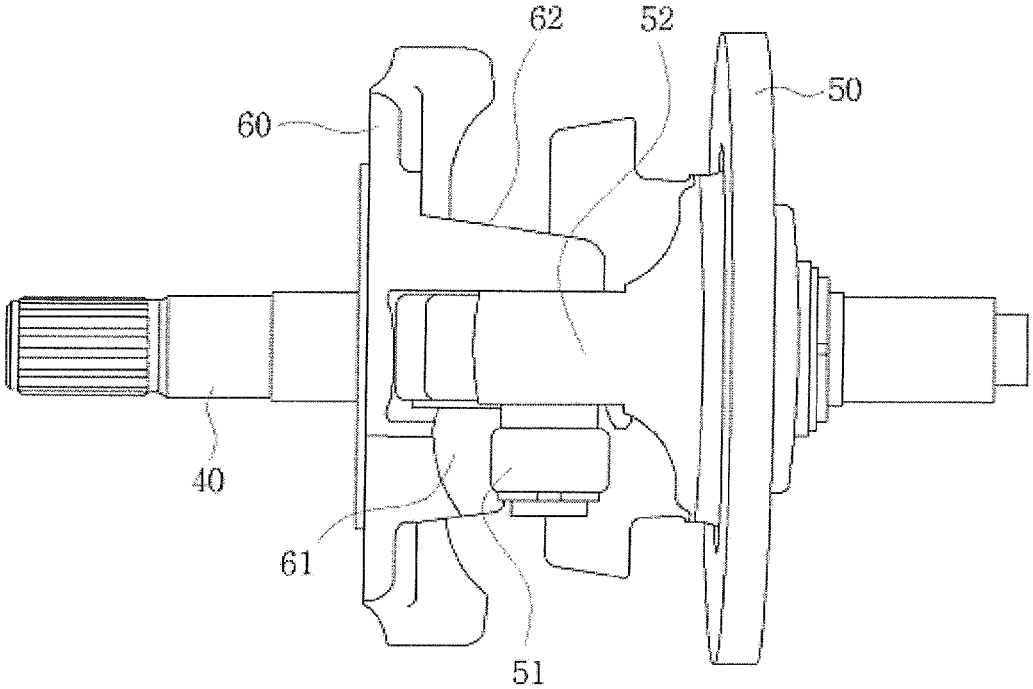
FIG. 1B is a cross-sectional view of a connection structure between a swash plate and a lug plate of FIG. 1A.

Since the housing 100, the cylinder block 200, the driving shaft 300, and the piston 600 are the same or similar to those of the variable displacement swash plate type compressor described with reference to FIG. 1A, details thereof are not repeated and only different components will be described here.

As shown in FIGS. 3 through 7, the lug plate 400 includes a protruding portion 410 protruding towards the swash plate 500, and the swash plate 500 includes a pair of arms 510*a* and 510*b* protruding towards the lug plate 400 on both sides of the protruding portion 410 of the lug plate 400.

The protruding portion 410 and the pair of arms 510*a* and 510*b* are mutually complementarily combined to each other.

A leading end of the protruding portion 410 extends to penetrate between the pair of arms 510*a* and 510*b*, thereby forming a rotatory power projection 413 transmitting power for rotating the swash plate 500.

Also, the lug plate 400 includes a guide groove 411*a* and a slope 411 for guiding a tilting movement while making surface contact with leading ends of the pair of arms 510*a* and 510*b* of the swash plate 500.

The guide groove 411*a* and the slope 411 exclusively perform a varying operation of the swash plate 500 between a maximum tilt angle and a minimum tilt angle.

Figure 4:
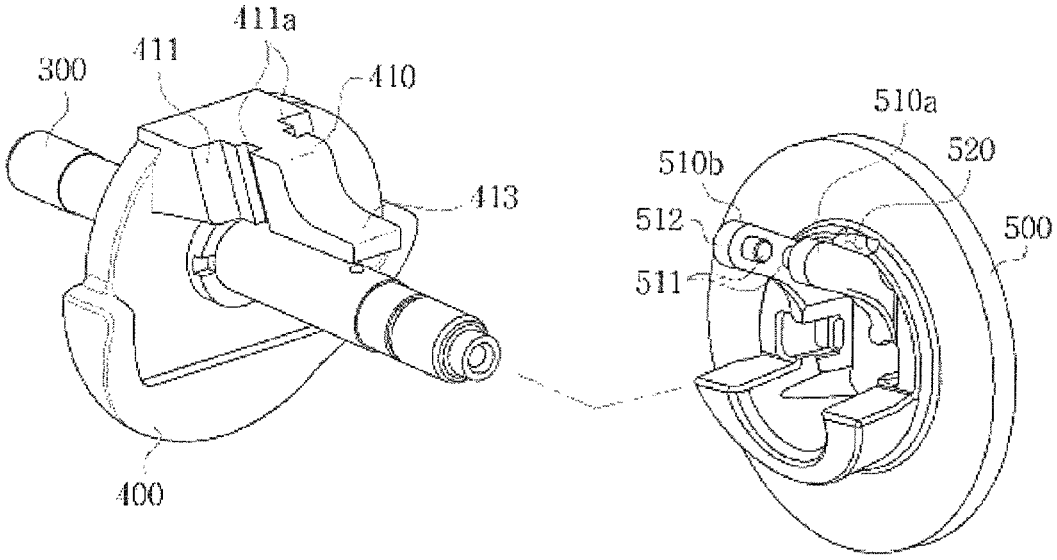
FIG. 4 is an exploded perspective view of the connection structure FIG. 3.
Figure 5:
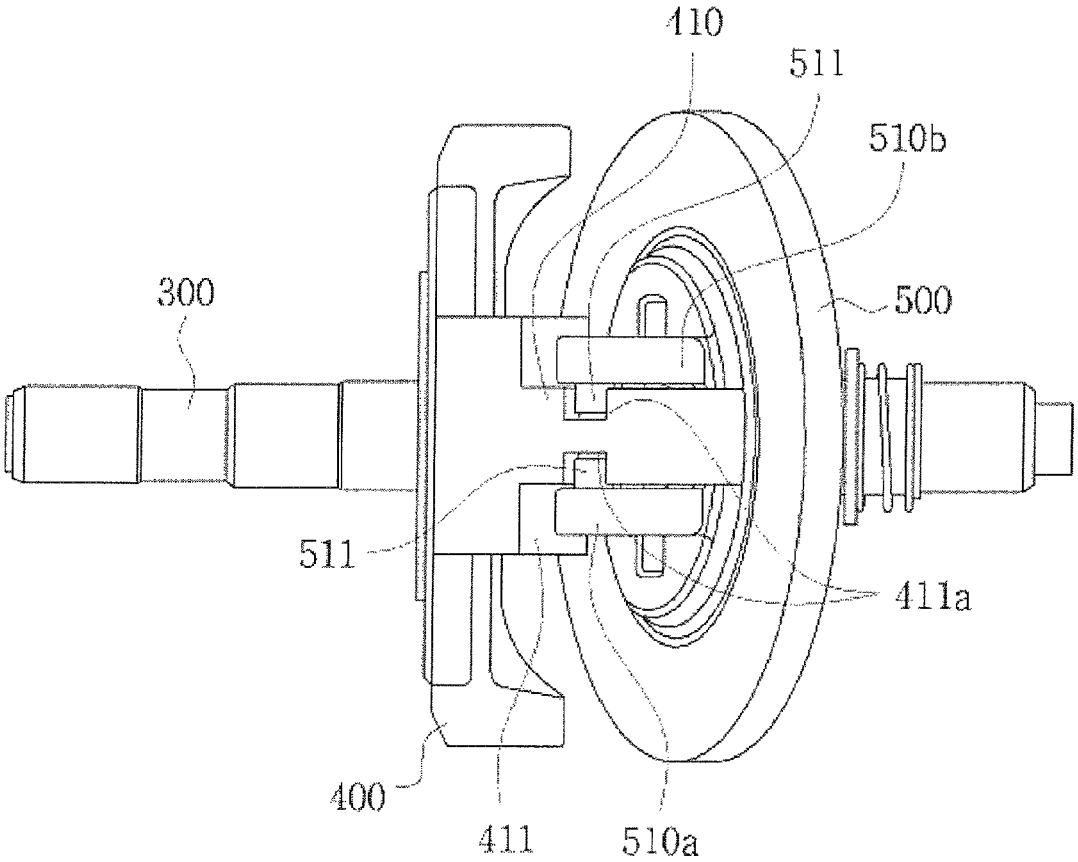
FIG. 5 is a plan view of the connection structure of FIG. 3.
Figure 6:
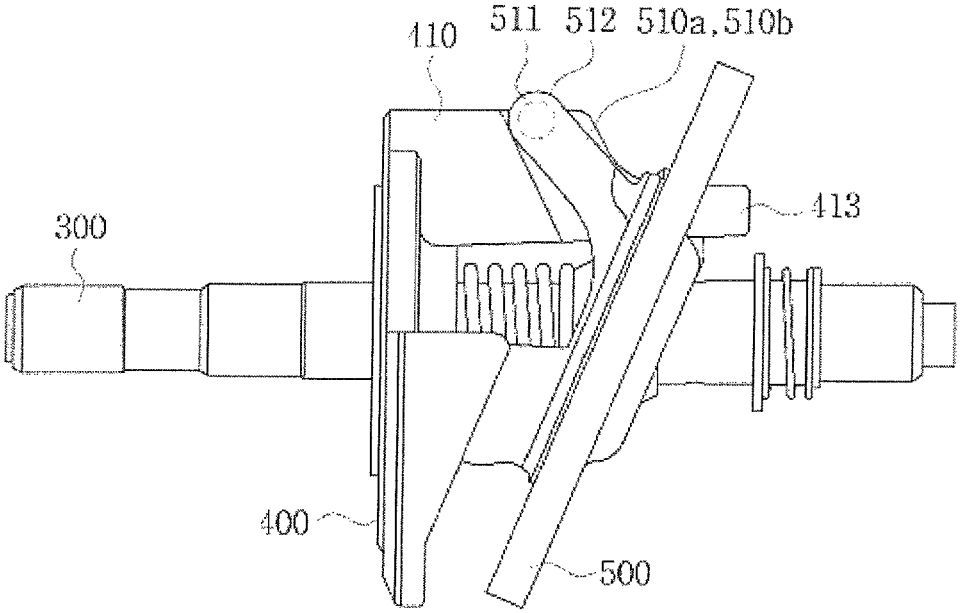
FIGS. 6A and 6B are front views for describing a varying operation of the connection structure of FIG. 3.
Figure 6:
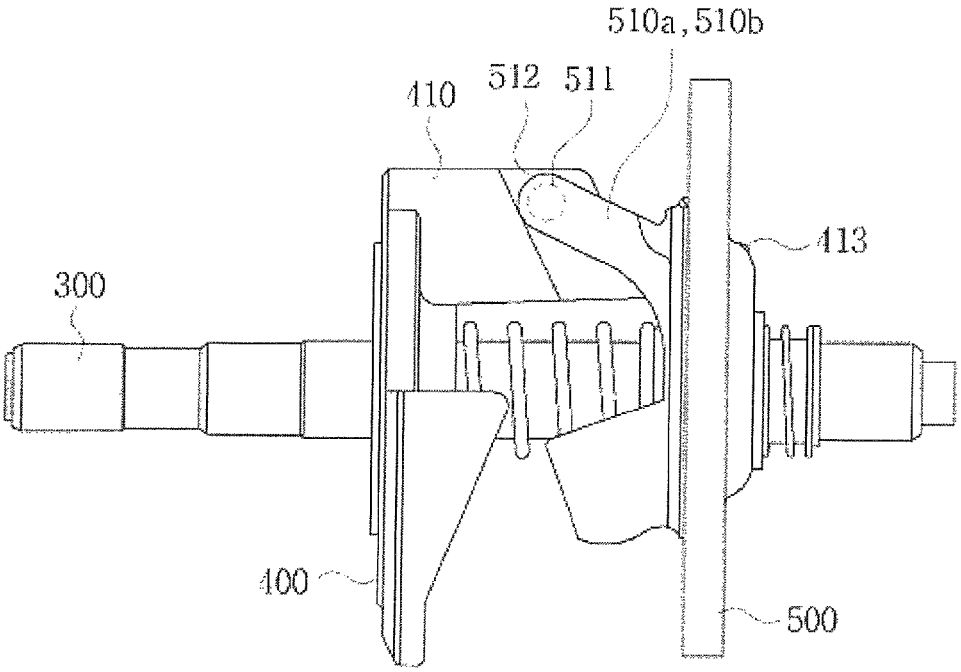
Figure 7:
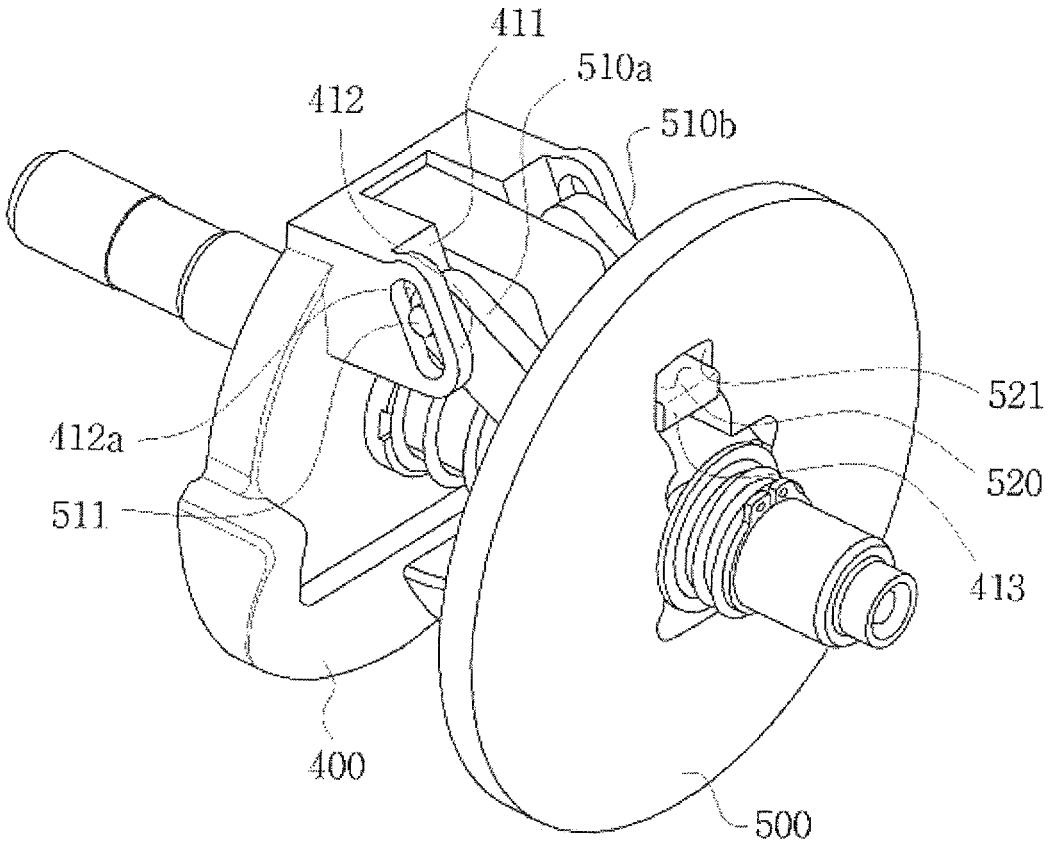
FIG. 7 is a perspective view of a connection structure between a swash plate and a lug plate of a variable displacement swash plate type compressor, according to another embodiment of the present invention.

Here, as shown in FIGS. 4 and 5, the guide groove 411*a* may be sunken at a predetermined depth towards an inside of the protruding portion 410, but a structure of the guide groove 411*a* is not limited thereto. Alternatively, as shown in FIG. 7, a guide member 412 protruding from an outer end of the slope 411 towards the swash plate 500 may be formed, and a coupling hole 412*a* to which a hinge pin 511 of the pair of arms 510*a* and 510*b* is combined may be formed in a length direction of the guide member 412.

Then, the rotatory power projection 413 formed at the leading end of the protruding portion 410 of the lug plate 400 transmits rotatory power while contacting an inner surface of the swash plate 500 through the swash plate 500.

Such a structure for performing the varying operation of the swash plate 500 between the maximum tilt angle and the minimum tilt angle and a structure for transmitting rotatory power for rotating the swash plate 500 are formed at different locations of the lug plate 400, and thus a load concentrated at one point of the protruding portion 410 of the lug plate 400 is reduced. Accordingly, not only the varying operation and rotating operation of the swash plate 500 are improved, but also durability of the protruding portion 410 is improved by distributing forces for the varying and rotating operations to different locations.

Meanwhile, the swash plate 500 includes the pair of arms 510*a* and 510*b* protruding on both sides of the protruding portion 410 of the lug plate 400.

Also, the hinge pin 511 elevating along the tilting movement of the swash plate 500 by being combined to the guide groove 411*a* is formed at one or the other side of the leading ends of the pair of arms 510*a* and 510*b*, and leading circumferences of the pair of arms 510*a* and 510*b* have circular arc surfaces 512 sliding along the slope 411 of the lug plate 400 according to the tilting movement of the swash plate 500.

In other words, based on elevating movement of the hinge pin 511 at a predetermined angle along a length direction of the guide groove 411*a*, the circular arc surfaces 512 also move while contacting the slope 411 of the lug plate 400, and thus the varying operation of the swash plate 500 between the maximum tilt angle and the minimum tilt angle is stably performed.

Here, the hinge pin 511 protrudes from each of the pair of arms 510*a* and 510*b*, but a structure of the hinge pin 511 is not limited thereto and the hinge pin 511 may have any structure for slope guidance.

For example, the hinge pin 511 may have a structure of a connection shaft connecting the pair of arms 510*a* and 510*b*. Here, it is obvious that the guide groove 411*a* is formed through the protruding portion 410 so that the hinge pin 511 connecting the pair of arms 510*a* and 510*b* is elevatable.

Specifically, a through hole 520 for accommodating the rotatory power projection 413 of the protruding portion 410 of the lug plate 400 is formed through a surface between the pair of arms 510*a* and 510*b* of the swash plate 500.

During rotation, the through hole 520 is closely adhered to one surface of the rotatory power projection 413 so as to directly transmit the rotatory power of the lug plate 400 to the swash plate 500, and thus rotatory power transmitting capacity may be further improved.

In other words, the pair of arms 510*a* and 510*b* are connected to the protruding portion 410 to perform the varying operation of the swash plate 500 between the maximum tilt angle and the minimum tilt angle, and the through hole 520 penetrating through the surface of the swash plate 500 further improves rotatory capacity for rotating the swash plate 500 by being directly connected to the rotatory power projection 413.

Also, a surface contact portion 521 may be formed at two sides of the through hole 520 facing two sides of the rotatory power projection 413 so that the two sides of the rotatory power projection 413 contact each other.

In addition, a portion where the rotatory power projection 413 and the through hole 520 contact each other may be coated with TEFLON™ so as to reduce frictional resistance.

According to the above embodiments of the present invention, tilt angle variation and rotatory power transmittance for the swash plate 500 may be simultaneously improved by forming the structure for performing the varying operation of the swash plate 500 between the maximum tilt angle and the minimum tilt angle and a structure for transmitting the rotatory power for rotating the swash plate 500 at different locations while the protruding portion 410 and the pair of arms 510*a* and 510*b* are mutually complementarily combined to each other.

Meanwhile, in the above one or more embodiments, the pair of arms 510*a* and 510*b* protruding towards the lug plate 400 on both sides of the protruding portion 410 of the lug plate 400 are formed at the swash plate 500, but the structure of the swash plate 500 is not limited thereto, and one arm protruding towards the lug plate 400 near the protruding portion 410 may be formed at the swash plate 500.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A variable displacement swash plate type compressor comprising:

a lug plate fixed to a driving shaft; and a swash plate coupled to the lug plate and whose tilt angle is varied between a maximum tilt angle and a minimum tilt angle according to rotatory motion of the lug plate, the swash plate having a through hole, wherein the lug plate comprises a protruding portion protruding towards the swash plate, and a rotatory power projection formed at a leading end of the protruding portion, the rotatory power projection penetrating through the through hole and making a surface contact with the swash plate while the swash plate moves between the maximum tilt angle and the minimum tilt angle such that the rotatory power projection transmits rotatory power of the lug plate to the swash plate for rotating the swash plate while the lug plate is rotated by the driving shaft and the swash plate moves between the maximum tilt angle and the minimum tilt angle.

2. The variable displacement swash plate type compressor of claim 1, wherein a pair of arms protruding towards the lug plate on both sides of the protruding portion of the lug plate is formed at the swash plate, wherein a guide member and a slope for guiding a tilting movement are formed at the lug plate while making surface contact with the pair of arms of the swash plate, and a hinge pin sliding along a coupling hole formed in the guide member is formed at the pair of arms.

3. The variable displacement swash plate type compressor of claim 1, wherein a surface contact portion is formed on two sides of the through hole of the swash plate, wherein the two sides of the through hole face two sides of the rotatory power projection.

4. The variable displacement swash plate type compressor of claim 3, wherein an arm protruding from a location near the protruding portion of the lug plate towards the lug plate is formed at the swash plate.

5. The variable displacement swash plate type compressor of claim 1, wherein an arm protruding from a location near the protruding portion of the lug plate towards the lug plate is formed at the swash plate.

6. The variable displacement swash plate type compressor of claim 5, wherein a guide member and a slope for guiding a tilting movement are formed at the lug plate while making surface contact with the arm of the swash plate, and a hinge pin sliding along a coupling hole formed in the guide member is formed at the arm.

7. The variable displacement swash plate type compressor of claim 1, wherein a pair of arms protruding towards the lug plate on both sides of the protruding portion of the lug plate is formed at the swash plate, wherein a guide groove and a slope for guiding a tilting movement are formed at the lug plate while making surface contact with the pair of arms of the swash plate, and a hinge pin sliding and combined to the guide groove is formed at the pair of arms.

8. The variable displacement swash plate type compressor of claim 7, wherein the guide groove is sunken at a predetermined depth towards an inside of the protruding portion.

9. The variable displacement swash plate type compressor of claim 7, wherein the hinge pin has a connecting shaft shape connecting the pair of arms, and the guide groove penetrates through the protruding portion for the hinge pin to be elevated therethrough.

* * * * *